US006883666B1

(12) United States Patent
Wang

(10) Patent No.: US 6,883,666 B1
(45) Date of Patent: Apr. 26, 2005

(54) PACKING FRAME STRUCTURE

(76) Inventor: Shing-Wong Wang, No. 1, Lane 273, Hsin Ming Rd., Na Fu District, Taipei (TW)

( * ) Notice: Subject to any disclaimer, the term of this patent is extended or adjusted under 35 U.S.C. 154(b) by 40 days.

(21) Appl. No.: 10/648,257

(22) Filed: Aug. 27, 2003

(51) Int. Cl.[7] ..... B65D 19/00
(52) U.S. Cl. ..... 206/600; 206/449; 220/4.33
(58) Field of Search ..... 206/386, 395–600, 206/321, 325, 820; 220/1.5, 4.28, 4.33, 4.34

(56) References Cited

U.S. PATENT DOCUMENTS 4,512,473 A * 4/1985 Thomaswick et al. ..... 206/454
5,056,666 A * 10/1991 Janssens ..... 206/600
5,762,222 A * 6/1998 Liu ..... 206/600
5,813,536 A * 9/1998 Bartholomew ..... 206/449
6,290,064 B1 * 9/2001 Kuhn et al. ..... 206/600

* cited by examiner

*Primary Examiner*—Luan K. Bui
(74) *Attorney, Agent, or Firm*—Troxell Law Office PLLC

(57) ABSTRACT

A packing frame structure is constructed to include two top rails and two bottom rails adapted for fastening to material elements at four sides to hold material elements a row and to protect packed material elements against shocks and impact, and two blocks adapted for fastening to the bottom rails at the bottom side to support the packing frame structure and the packed material elements above a flat surface for enabling the package to be conveniently carried by a forklift. The top rails each have a top wall and through holes in the top wall for the hooking of the hook of a truck crane or the like.

3 Claims, 8 Drawing Sheets

PACKING FRAME STRUCTURE

BACKGROUND AND SUMMARY OF THE INVENTION

The present invention relates to a packing frame structure and, more particularly, to such a packing frame structure, which is practical for holding solid material elements stably in a row for delivery and storage to hook the carried solid material elements well protected against shocks or impact.

In order to protect solid material elements, for example, plate members against scratching and impact during delivery, packing materials and cartons/boxes are commonly used to pack solid material elements before delivery. It is expensive to pack solid material elements in this manner for delivery.

The present invention has been accomplished under the circumstances in view. It is the main object of the present invention to provide a packing frame structure, which is practical for holding solid material elements stably in a row for delivery. It is another object of the present invention to provide a packing frame structure, which well protects the solid material elements held therein against shocks and scratching without the use of any packing materials. According to one aspect of the present invention, the packing frame structure comprises two top rails and two bottom rails adapted for fastening to material elements at four sides to hold material elements a row and to protect packed material elements against shocks and impact. According to another aspect of the present invention, two blocks are respectively fastened to the bottom rails at the bottom side to support the packing frame structure and the packed material elements above a flat surface for enabling the package to be conveniently carried by a forklift. According to still another aspect of the present invention, a plurality of packing frame structures can be fastened to one another in a stack to hold multiple sets of material elements at different elevations.

DETAILED DESCRIPTION OF THE PREFERRED EMBODIMENT

Figure 1:
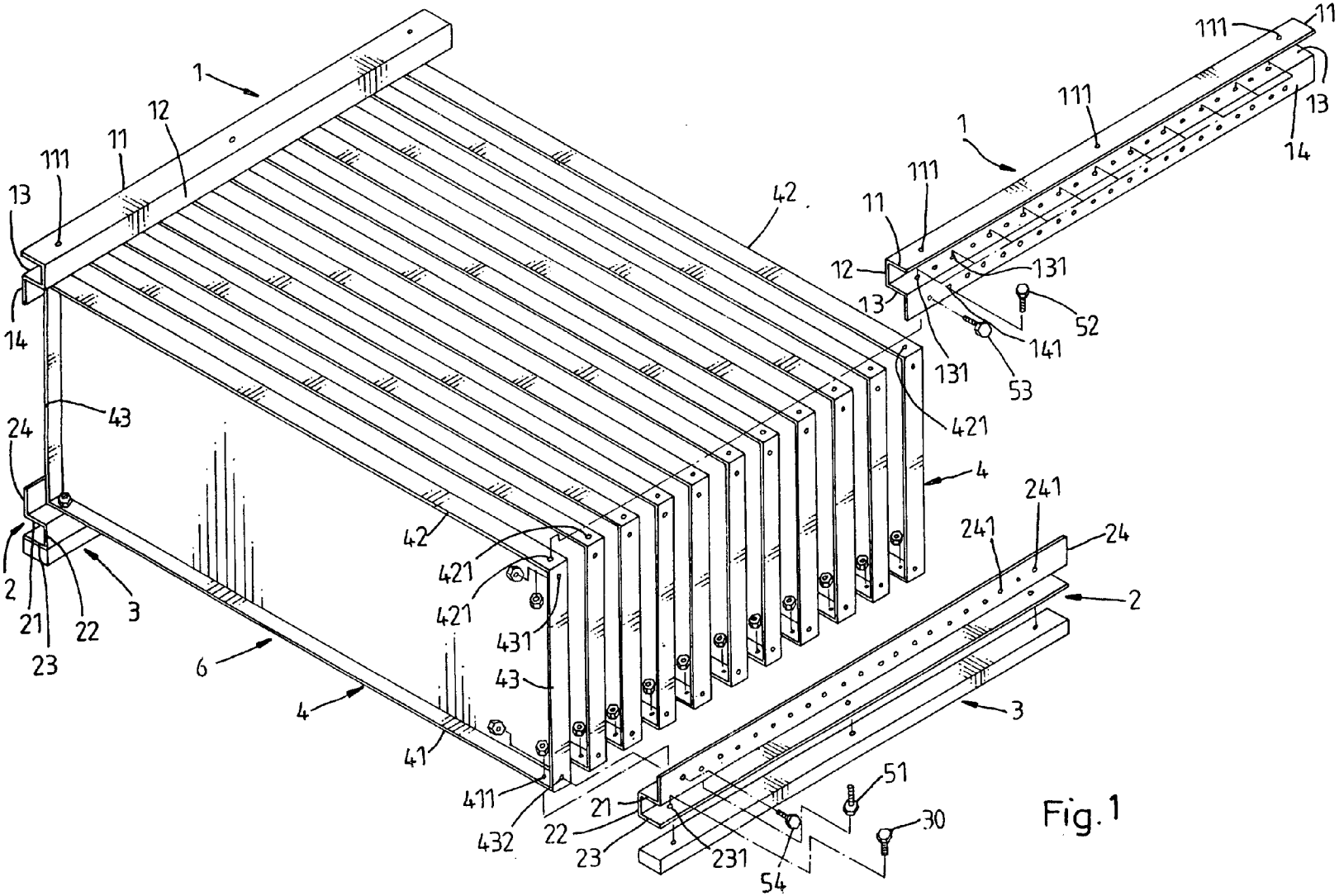
FIG. 1 is an exploded view of a first embodiment of the present invention.
Figure 2:
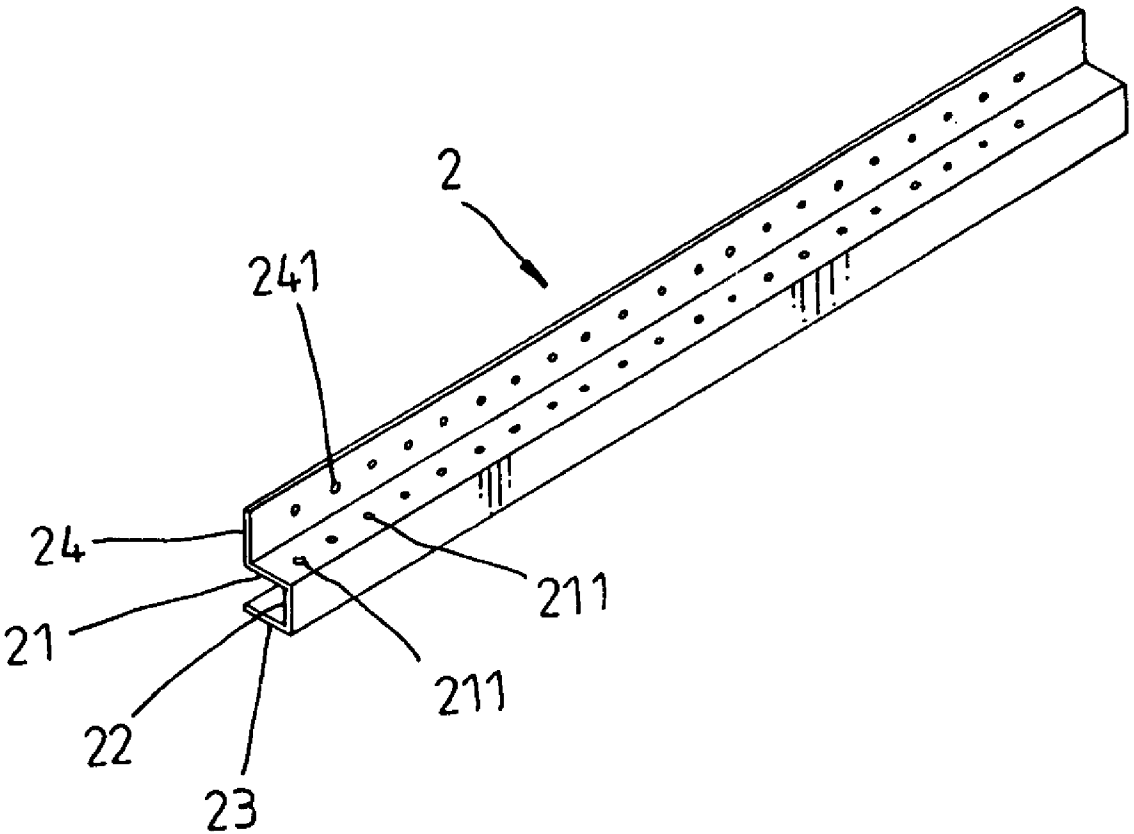
FIG. 2 is a perspective view of one bottom rail according to the first embodiment of the present invention.
Figure 3:
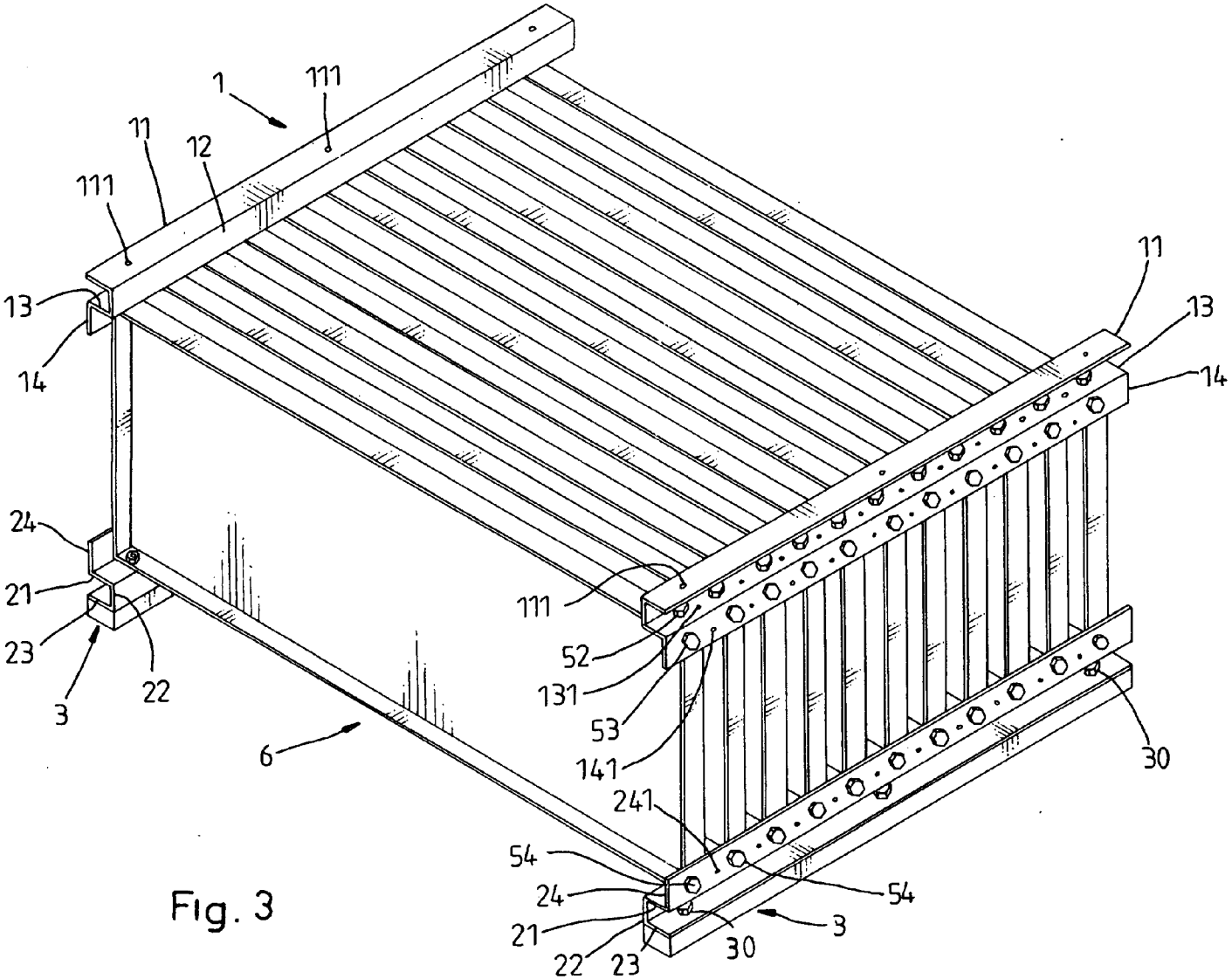
FIG. 3 is a perspective showing one application example of the first embodiment of the present invention.

Referring to FIGS. 1–3, a packing frame structure in accordance with the present invention is shown comprised of two top rails 1, two bottom rails 2, and two blocks 3.

The top rails 1 each comprise an elongated top wall 11, an elongated bottom wall 13, and an elongated vertical connecting wall 12 connected between one long side of the top wall 11 and one long side of the bottom wall 13. The bottom wall 13 comprises a plurality of locating holes 131 spaced along the length thereof in a line. The top wall 11 comprises a plurality of through holes 111 spaced along the length thereof in a line.

The bottom rails 2 each comprise an elongated top wall 21, an elongated bottom wall 23, and an elongated connecting sidewall 22 connected between one long side of the top wall 21 and one long side of the bottom wall 23. The top wall 21 comprises a plurality of locating holes 211 spaced along the length thereof in a line. The bottom wall 23 comprises a plurality of through holes 231 spaced along the length thereof in a line.

The blocks 3 are narrow elongated members respectively attached to the bottom surfaces of the bottom walls 23 of the bottom rails 2 and fixedly fastened to the through holes 231 of the bottom walls 23 of the bottom rails 2 by fastening devices, for example, screws 30.

The locating holes 211 of the top walls 21 of the bottom rails 2 are fastened to a respective locating hole 411 in the bottom flange 41 of each of a number of planar material elements 4 by a respective fastening device, for example, a respective screw 51, keeping the planar material elements 4 supported on the bottom rails 2 above the blocks 3 and vertically arranged in parallel. After connection of the planar material elements 4 to the bottom rails 2, the top rails 1 are respectively bilaterally attached to the planar material elements 4 at the top and arranged in parallel to the bottom rails 2, and then fastening devices, for example, screws 52 are respectively mounted in the locating holes 131 of the bottom walls 13 of the top rails 1 and fastened to a respective locating hole 421 in the top flange 42 of each planar material element 4 to fix the top rails 1 to the planar material elements 4, keeping the planar material elements 4 well protected by the top rails 1 and the bottom rails 2. When installed, a fork entry 6 is defined between the blocks 3 beneath the planar material elements 4 into which the forks of a forklift truck can be inserted for lifting and moving the packed planar material elements 4. A crane may be used to carry the packed planar material elements 4 to the desired place. When a crank is used, the hook of the hoisting block at the end of the hoisting rope of the crank can be hook in one through hole 111 of the top wall 11 of one top rail 1.

Figure 4:
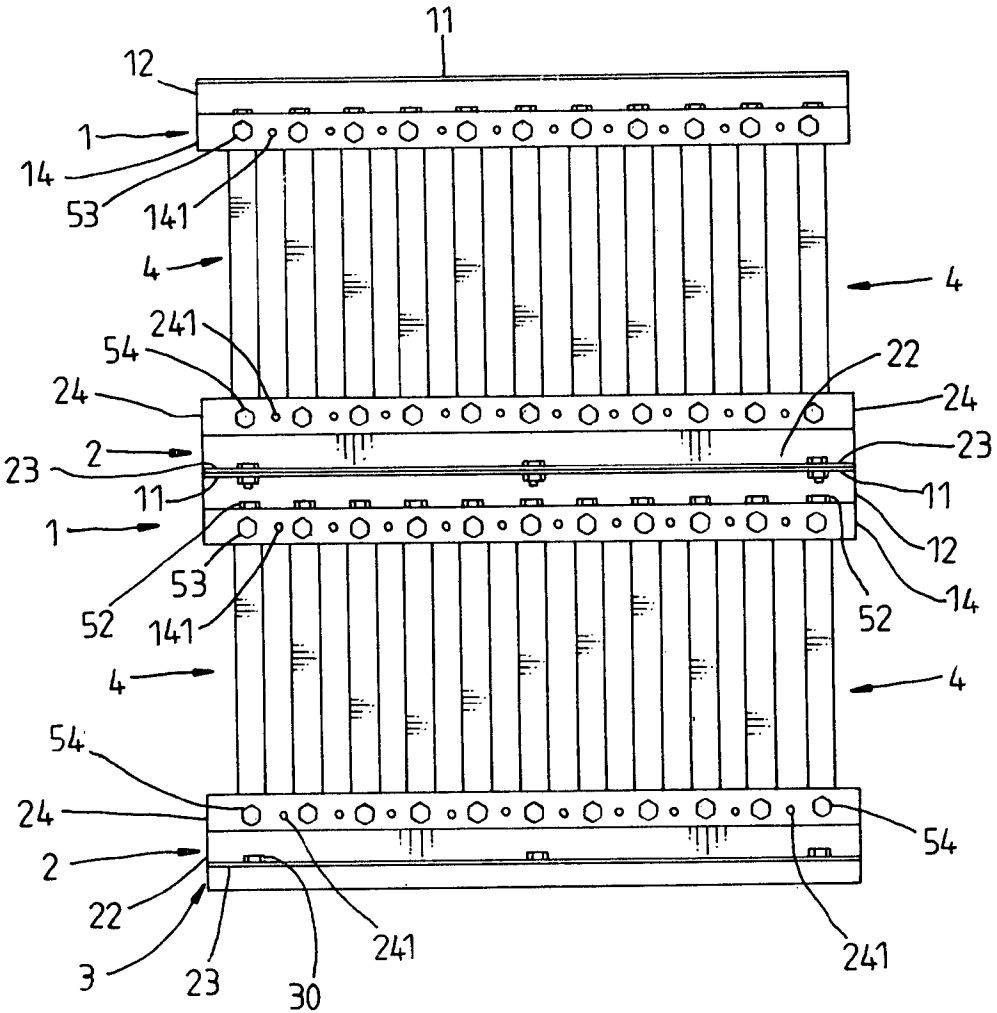
FIG. 4 is a side view showing another application example of the first embodiment of the present invention where two detachable pallets are arranged in a stack.

Referring to FIG. 4, when a number of material elements 4 packed in a first packing frame structure, a second packing frame structure, after removal of the blocks 3 from the respective bottom rails 2, can be fastened to the first packing frame structure to hold another set of material elements 4 above the first packing frame structure. In this case, the through holes 231 of the bottom walls 23 of the second packing frame structure are selectively fastened to the through holes 111 of the top walls 11 of the top rails 1 of the first packing frame structure. By means of this arrangement, multiple packing frame structures can be fastened to one another to hold multiple sets of material elements 4 at different elevations.

Figure 7:
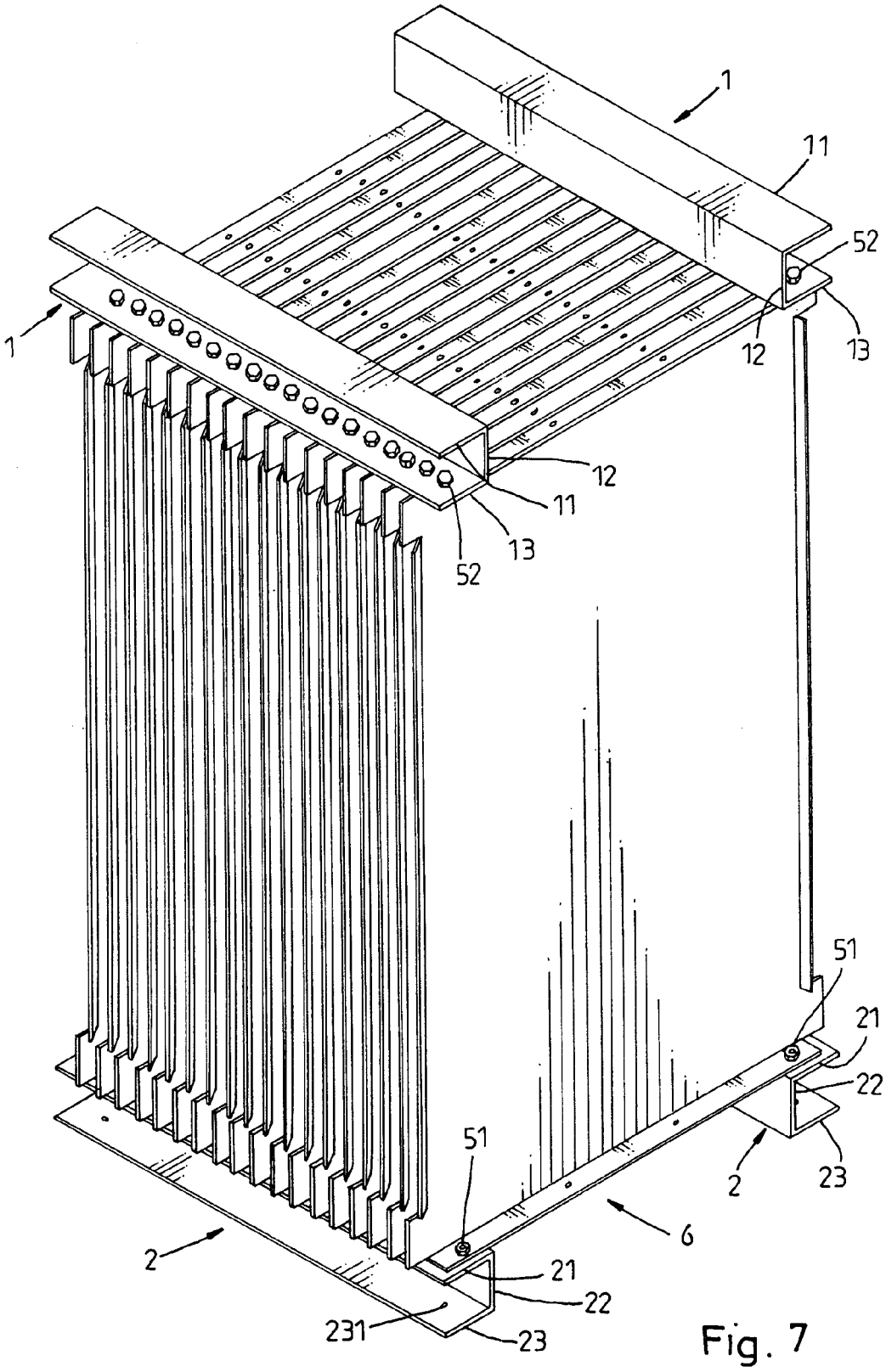
FIG. 7 shows another application example of the second embodiment of the present invention.
Figure 8:
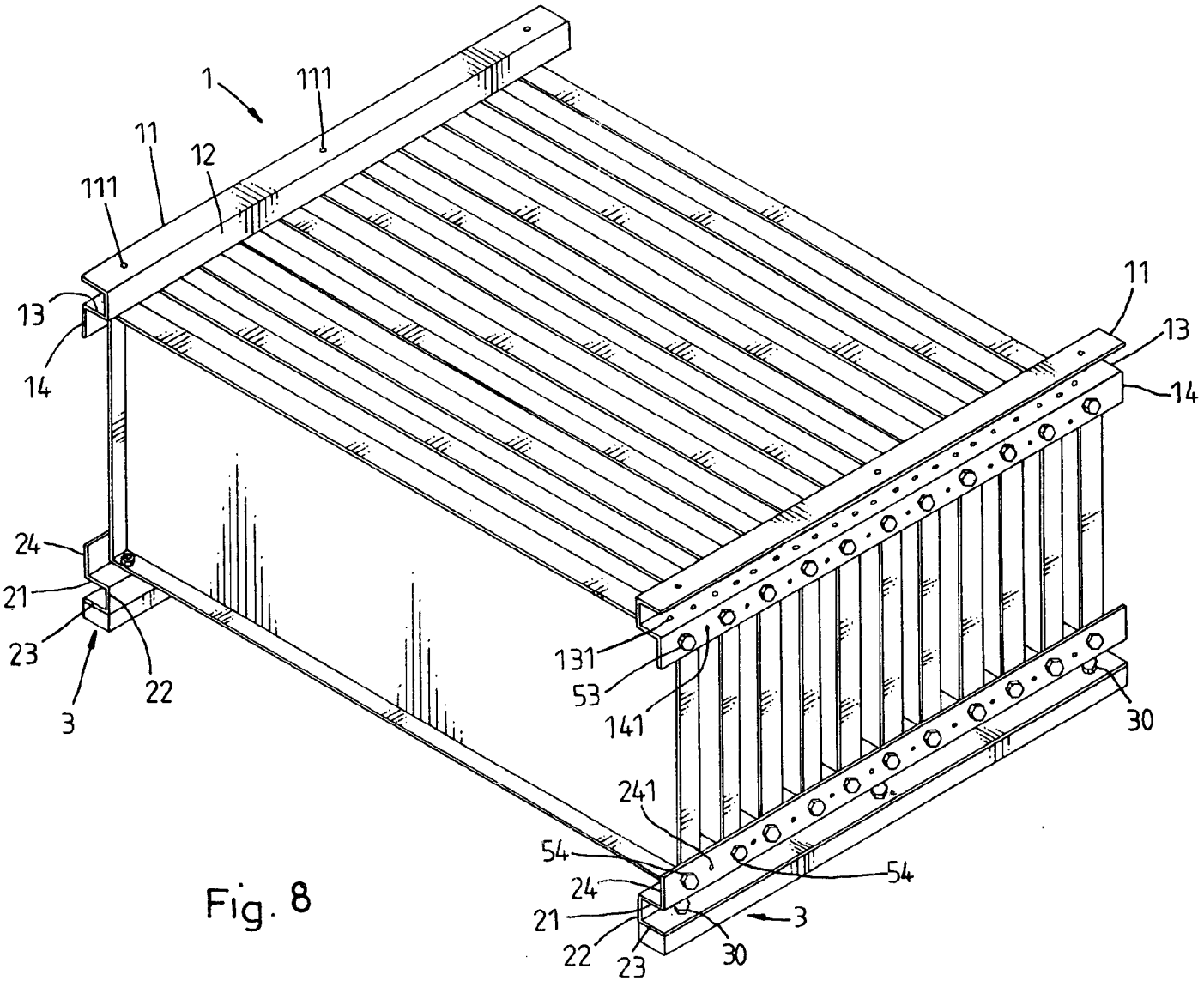
FIG. 8 shows still another application example of the second embodiment of the present invention.

Referring to FIGS. 1–3 again, each top rail 1 further comprises an elongated sidewall 14 perpendicularly downwardly extended along one long side of the respective bottom wall 13 in direction reversed to the respective elongated vertical connecting wall 12. The sidewall 14 has a plurality of locating holes 141 longitudinally spaced in a line and adapted for fastening to a respective top locating hole 431 in one side flange 43 of each material element 4 by a respective fastening device, for example, a respective screw 53. Each bottom rail 2 further comprises an elongated sidewall 24 perpendicularly upwardly extended along one long side of the respective top wall 21 in direction reversed to the respective elongated vertical connecting wall 22. The sidewall 24 has a plurality of locating holes 241 spaced in a line along the length thereof and adapted for fastening to a respective bottom locating hole 432 in one side flange 43 of each material element 4 by a respective fastening device, for example, a respective screw 54. According to the application example shown in FIG. 3, the locating holes 131; 141 of the bottom walls 13 and sidewalls 14 of the top rails 1 as well as the locating holes 211;241 of the top walls 21 and sidewalls 24 of the bottom rails 2 are fastened to the respective locating holes 411;421;431;432 of the material elements 4 by screws 51;52;53;54. According to the application example shown in FIG. 8, only the locating holes 141 of the sidewalls 14 of the top rails 1 and the locating holes 241 of the sidewalls 24 of the bottom rails 2 are fastened to the respective locating holes 431;432 of the material elements 4 by screws 53;54. FIG. 7 shows another application example of the present invention. According to this application example, the aforesaid blocks 3 are eliminated.

Figure 6:
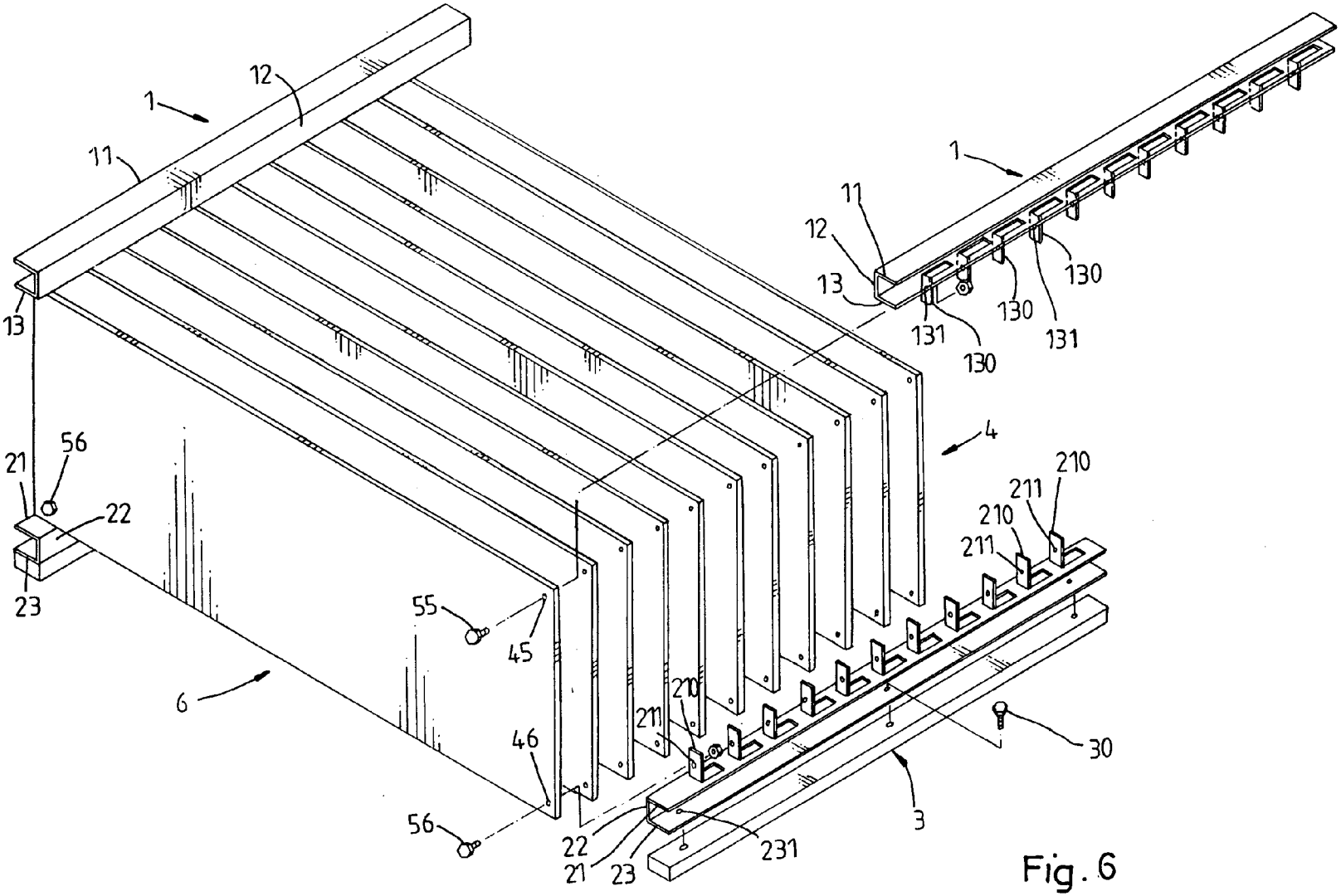
FIG. 6 is a perspective exploded view of a second embodiment of the present invention.

FIG. 6 shows a packing frame structure according to a second embodiment of the present invention. According to this embodiment, the aforesaid sidewalls 14;24 are respectively eliminated from the top rails 1 and the bottom rails 2. Further, the locating holes 131 of each top rail 1 as well as the locating holes 211 of each bottom rail 2 are not disposed at the same plane, that is, the bottom wall 13 of each top rail 1 comprises a plurality of downward lugs 130 spaced along the length and aligned in a line and defining a respective locating hole 131; the top wall 21 of each bottom rail 2 comprises a plurality of upright lugs 210 spaced along the length and aligned in a line and defining a respective locating hole 211. The downward lugs 130 are formed of a part of the bottom wall 13 of the respective top rail 1 by stamping. The upright lugs 210 are formed of a part of the top wall 21 of the respective bottom rail 2 by stamping. The locating holes 131 of the downward lugs 130 of the top rails 1 and the locating holes 211 of the upright lugs 210 of the bottom rails 2 can be fastened to respective locating holes 45;46 of flat material elements 4 by respective screws 55;56.

Figure 5:
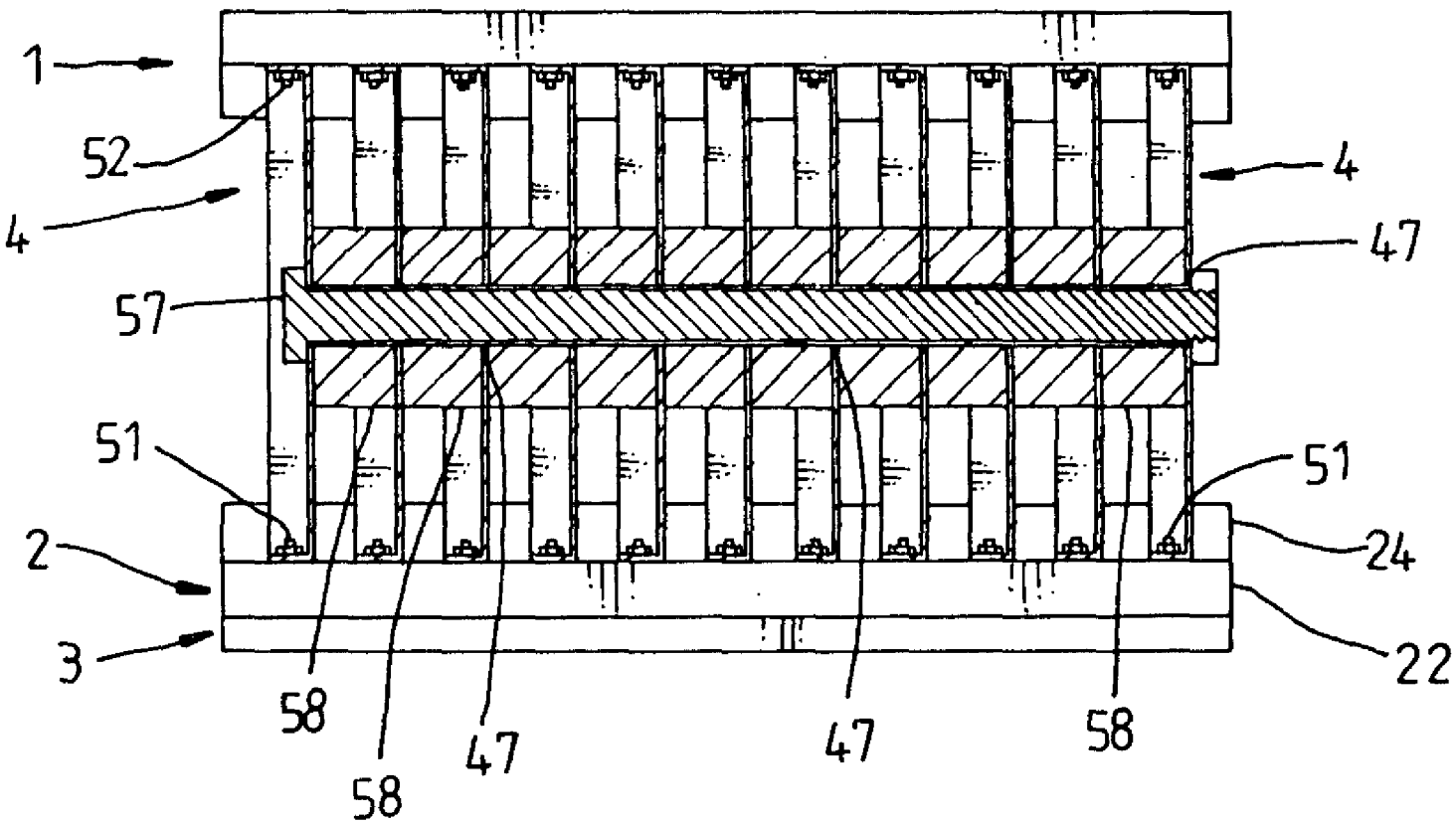
FIG. 5 is a cross sectional view of FIG. 3.

Referring to FIG. 5 again, spacer blocks 58 may be set in between each two adjacent material elements 4 and secured thereto by a screw bolt 57. The material elements 4 each have a locating hole 47 for the mounting of the screw bolt 57.

What is claimed is:

1. A packing frame structure adapted for fastening to flat material elements at four sides to hold said flat material elements a row and to protect said material elements against shocks and impact, the packing frame structure comprising:

two top rails, said top rails each comprising an elongated top wall having a first long side and a second long side, an elongated bottom wall having a first long side and a second long side, and an elongated vertical connecting wall connected between the first long side of the top wall of the respective top rail and the first long side of the bottom wall of the respective top rail, the bottom wall of each of said top rails comprising a plurality of locating holes spaced along the length thereof in a line and adapted for fastening to a respective locating hole of each of said material elements by a respective fastening device, the top wall of each of said top rails comprising a plurality of through holes spaced along the length thereof in a line for the hooking of the hook of a crane or the connection of a second packing frame structure;

two bottom rails, said bottom rails each comprising an elongated top wall having a first long side and a second long side, an elongated bottom wall having a first long side and a second long side, and an elongated connecting sidewall connected between the first long side of the top wall of the respective bottom rail and the first long side of the bottom wall of the respective bottom rail, the top wall of each of said bottom rails comprising a plurality of locating holes spaced along the length thereof in a line and adapted for fastening to a respective locating hole of each of said material elements by a respective fastening device, the bottom wall of each of said bottom rails comprising a plurality of through holes spaced along the length thereof in a line; and two narrow elongated blocks adapted for attaching to the bottom walls of said bottom rails and fixedly fastened to the through holes of the bottom walls of said bottom rails by respective fastening devices to support said bottom rails above a flat surface for enabling the packing frame structure with said material elements to be carried by a forklift.

2. The packing frame structure as claimed in claim 1, wherein said top rails each further comprise an elongated sidewall perpendicularly downwardly extended along the second long side of the respective bottom wall in direction reversed to the respective elongated connecting wall, the sidewall of each of said top rails having a plurality of locating holes longitudinally spaced in a line and adapted for fastening to a respective top locating hole in one side flange of each of said material elements by a respective fastening device; said bottom rails each further comprise an elongated sidewalls perpendicularly upwardly extended along the second long side of the respective top wall in direction reversed to the respective elongated connecting wall, the sidewall of each of said bottom rails having a plurality of locating holes longitudinally spaced in a line and adapted for fastening to a respective bottom locating hole in one side flange of each of said material elements by a respective fastening device.

3. The packing frame structure as claimed in claim 1, wherein the bottom wall of each of said top rails comprises a plurality of downward lugs spaced along the length thereof and aligned in a line, said downward lugs each having a locating hole for fastening to a respective locating hole of each of said material elements by respective fastening device; the top wall of each of said bottom rails comprises a plurality of upright lugs spaced along the length thereof and aligned in a line, said upright lugs having a locating hole for fastening to a respective locating hole of each of said material elements by a respective fastening device.

* * * * *